US009528481B2

(12) United States Patent
Yasukawa et al.

(10) Patent No.: US 9,528,481 B2
(45) Date of Patent: Dec. 27, 2016

(54) FUEL INJECTION VALVE

(71) Applicant: Hitachi Automotive Systems, Ltd., Hitachinaka-shi, Ibaraki (JP)

(72) Inventors: Yoshihito Yasukawa, Tokyo (JP); Motoyuki Abe, Tokyo (JP); Hideharu Ehara, Hitachinaka (JP); Tohru Ishikawa, Hitachinaka (JP); Eiji Ishii, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/819,037

(22) Filed: Aug. 5, 2015

(65) Prior Publication Data

US 2015/0337782 A1 Nov. 26, 2015

Related U.S. Application Data

(63) Continuation of application No. 14/232,725, filed as application No. PCT/JP2011/004378 on Aug. 3, 2011, now Pat. No. 9,103,311.

(51) Int. Cl.
*F02M 61/00* (2006.01)
*B05B 1/30* (2006.01)
(Continued)

(52) U.S. Cl.
CPC ..... *F02M 51/061* (2013.01); *F02M 61/162* (2013.01); *F02M 61/182* (2013.01);
(Continued)

(58) Field of Classification Search
CPC F02M 61/182; F02M 61/162; F02M 61/1813; F02M 61/1833; F02M 61/1826; F02M 51/067
(Continued)

(56) References Cited

U.S. PATENT DOCUMENTS 6,065,692 A 5/2000 Brinn, Jr.
6,179,227 B1 1/2001 Ren et al.
(Continued)

FOREIGN PATENT DOCUMENTS

DE 102 10 976 A1 9/2003
JP 2006-105067 A 4/2006
(Continued)

OTHER PUBLICATIONS

PCT International Search Report on application PCT/JP2011/004378 mailed Nov. 15, 2011; 2 pages.

*Primary Examiner* — Davis Hwu
(74) *Attorney, Agent, or Firm* — Foley & Lardner LLP

(57) ABSTRACT

Fuel injection valve with conical valve seat surface that abuts a valve body to seal fuel, fuel injection orifices having an inlet opening formed on the valve seat surface, wherein fuel sprays injected from the plurality of fuel injection orifices include a first fuel spray constituted by a fuel spray injected from at least one fuel injection orifice and a second fuel spray constituted by a plurality of fuel sprays injected at an outer periphery of the first fuel spray, and a fuel injection orifice that injects the first fuel spray constituted with a plane that includes an orifice axis connecting a center of an inlet with a center of an outlet of the fuel injection orifice, parallel to a center axis of the fuel injection valve intersecting a plane, a conical apex that forms the valve seat surface to form an inclination angle that is larger than 0°.

6 Claims, 7 Drawing Sheets

(51) Int. Cl.
*F02M 51/06* (2006.01)
*F02M 61/18* (2006.01)
*F02M 61/16* (2006.01)

(52) U.S. Cl.
CPC .... *F02M 61/1806* (2013.01); *F02M 61/1813* (2013.01); *F02M 61/1833* (2013.01)

(58) Field of Classification Search
USPC ... 239/533.12, 533.14, 496, 558, 584, 585.5
See application file for complete search history.

(56) References Cited

U.S. PATENT DOCUMENTS

| | | | | |
|---|---|---|---|---|
| 6,257,496 | B1 | 7/2001 | Wyant | |
| 6,481,646 | B1 | 11/2002 | Hornby | |
| 6,783,085 | B2 | 8/2004 | Xu | |
| 9,103,311 | B2 * | 8/2015 | Yasukawa | F02M 61/1813 |
| 2004/0056115 | A1 | 3/2004 | Peterson, Jr. | |
| 2009/0133668 | A1 | 5/2009 | Ashizawa | |

FOREIGN PATENT DOCUMENTS

| | | | |
|---|---|---|---|
| JP | 2007-107459 | A | 4/2007 |
| JP | 2007-231924 | A | 9/2007 |
| JP | 2008-051075 | A | 3/2008 |

* cited by examiner

FUEL INJECTION VALVE

CROSS-REFERENCE TO RELATED PATENT APPLICATIONS

This application is a Continuation of U.S. application Ser. No. 14/232,725 (National Stage of PCT/JP2011/004378), filed Jan. 14, 2014, incorporated herein by reference in its entirety.

TECHNICAL FIELD

The present invention relates to a fuel injection valve used in an internal combustion engine such as a gasoline engine, in which fuel leaks are prevented by abutting a valve body to a valve seat and fuel injection is carried out by separating the valve body from the valve seat.

BACKGROUND ART

A fuel injection valve in which a fuel spray is spread by generating a drift current in the fuel flow by decentering a center axis direction of an orifice relative to a center axis of a nozzle body is known (see PTL 1). In this fuel injection valve, since the center axis direction of the orifice is decentered relative to the center axis of the nozzle body, the shape of an inlet portion of the orifice which appears on an inner wall surface of the nozzle body is elliptical, and thus a drift current can be generated in a flow of fuel entering into the orifice compared to a case in which the shape of the inlet portion is close to a perfect circle. The fuel in which a drift current has been generated creates a swirling flow within the orifice, and thus the shape of the fuel spray at an outlet portion of the orifice can be spread.

CITATION LIST

Patent Literature

PTL 1: JP 2007-107459 A

SUMMARY OF INVENTION

Technical Problem

Particulate substances such as HC (hydrocarbon) and soot included in exhaust gas are produced when fuel that has collided into and adhered to a wall surface within a cylinder or an air intake valve and the like remains in an unburned state in which flames have difficulty propagating and thus becomes locally rich. In order to suppress such phenomena, it is necessary to shorten the fuel spray itself so that the fuel spray does not collide into the wall surface within the cylinder and to increase the constitutional degree of freedom of the fuel spray shape in order to enable the fuel spray to be laid out so that the fuel spray does not collide into the air intake valve and the like.

In the fuel injection valve according to PTL 1, a drift current is generated in the fuel flow by decentering the center axis direction of the orifice relative to the center axis of the nozzle body, and thereby the spray can be spread. However, PTL 1 does not sufficiently describe the effects that decentering has on the fuel flow or fuel spray. Also, PTL 1 does not sufficiently examine the lay out of the fuel spray within the cylinder, and the fuel spray may collide into and adhere to the inner wall within the cylinder or the air intake valve and the like because the fuel spray spreads out centered on the fuel injection valve.

An object of the present invention is to provide a fuel injection valve in which the constitutional degree of freedom of the fuel spray shape is high and the fuel spray travel is short so as to reduce the amount of fuel that adheres to the air intake valve or the wall surface within the cylinder when fuel is directly injected into the cylinder.

Solution to Problem

In order to achieve the above-described object, in the fuel injection valve of the present invention, the fuel spray travel (penetration) is suppressed and the adherence of fuel to the air intake valve or the wall surface within the cylinder is prevented by applying the following technologies to a fuel injection orifice that can easily lead to increases in the fuel spray travel (penetration).

That is, there is provided a fuel injection valve including: a conical valve seat surface that abuts a valve body to seat fuel; and a plurality of fuel injection orifices having an inlet opening formed on the valve seat surface, wherein fuel sprays injected from the plurality of fuel injection orifices include a first fuel spray constituted by a fuel spray injected from at least one fuel injection orifice and a second fuel spray constituted by a plurality of fuel sprays injected at an outer periphery of the first fuel spray, and a fuel injection orifice that injects the first fuel spray is constituted such that a plane that includes an orifice axis connecting a center of an inlet with a center of an outlet of the fuel injection orifice and is parallel to a center axis of the fuel injection valve intersects a plane including a straight line passing through the center of the inlet of the fuel injection orifice and a conical apex that forms the valve seat surface as well as the center axis of the fuel injection valve to form an inclination angle that is larger than 0°.

Advantageous Effects of Invention

According to the present invention, a fuel injection valve can be provided in which lay out of the fuel spray can be increased and adherence of fuel to the air intake valve or the like within the cylinder can be eliminated while simultaneously enabling the fuel spray travel to be shortened, thereby realizing an internal combustion engine with enhanced air exhaust performance.

DESCRIPTION OF EMBODIMENTS

Embodiments of the present invention will now be explained below.

First Embodiment

A fuel injection valve according to a first embodiment of the present invention will be explained below referring to FIGS. 1 to 7.

Figure 1:
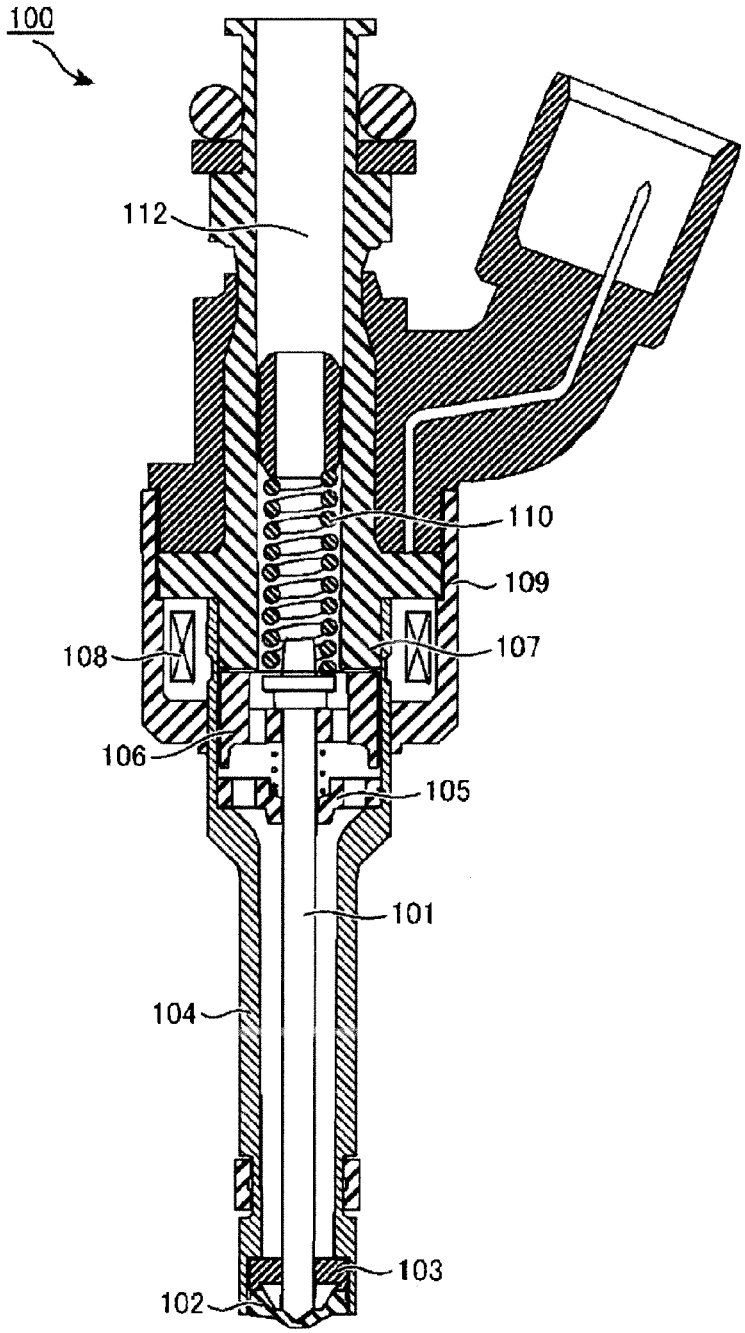
FIG. 1 is a vertical cross-section view parallel to a center axis of a fuel injection valve that illustrates an embodiment of a fuel injection valve according to the present invention.
Figure 2:
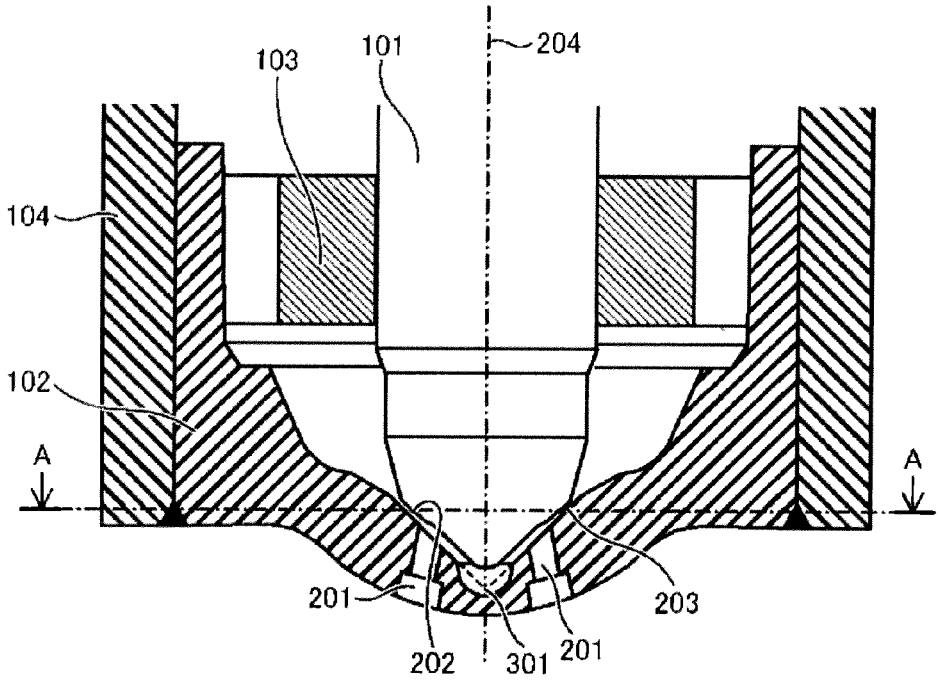
FIG. 2 is an enlarged vertical cross-section view of the vicinity of a nozzle tip of a fuel injection valve according to a first embodiment of the present invention.
Figure 3:
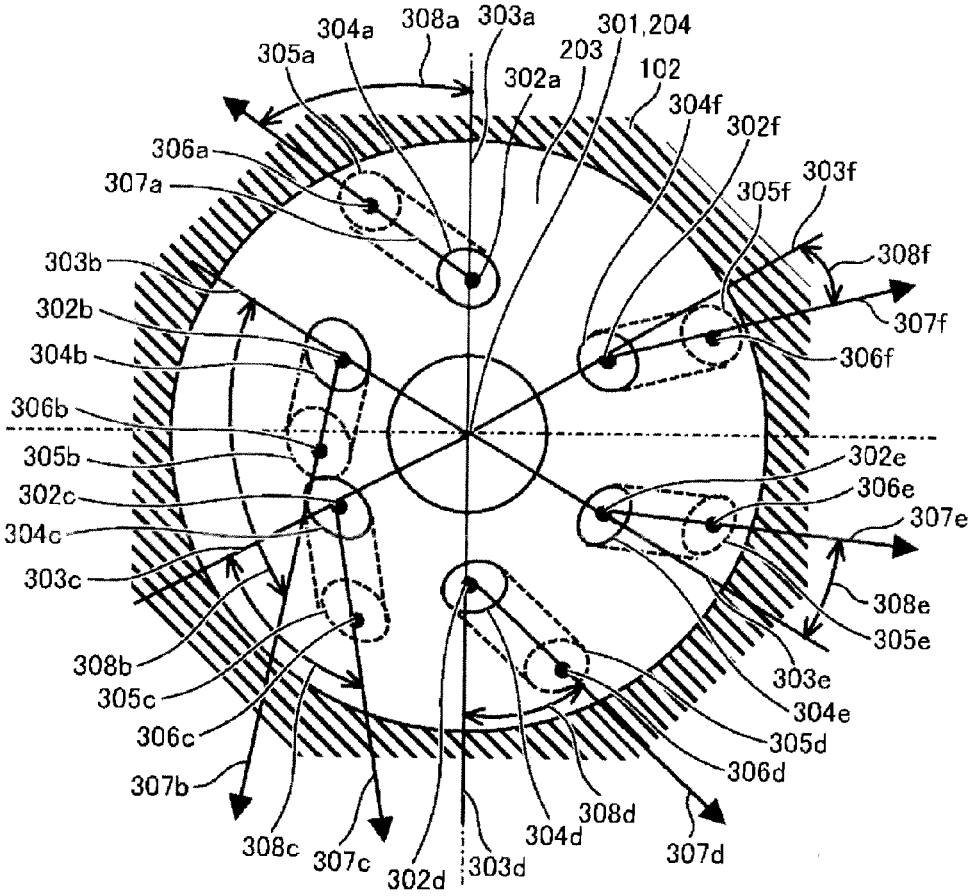
FIG. 3 is a cross-section view along line A-A in FIG. 2 according to the first embodiment of the present invention.
Figure 4:
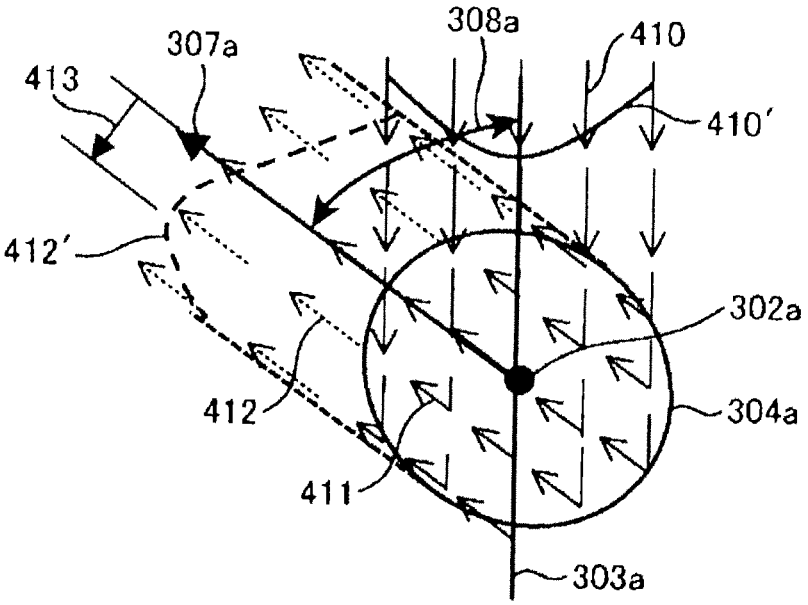
FIGS. 4(*a*) and 4(*b*) are enlarged views illustrating one fuel injection orifice according to the first embodiment of the present invention.
Figure 4B:
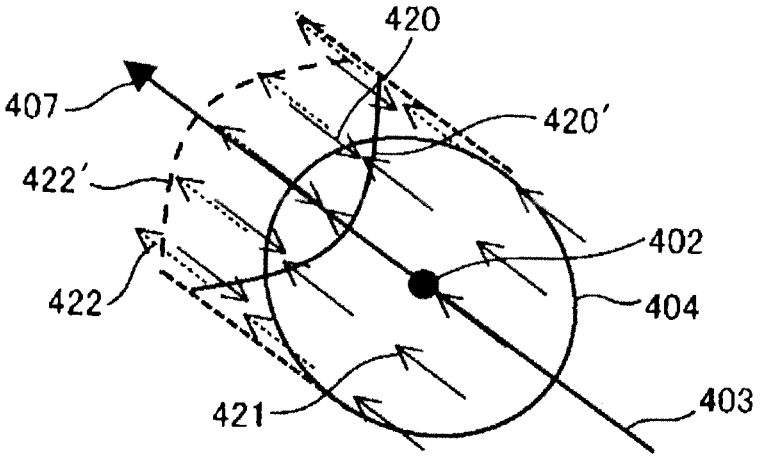
Figure 5:
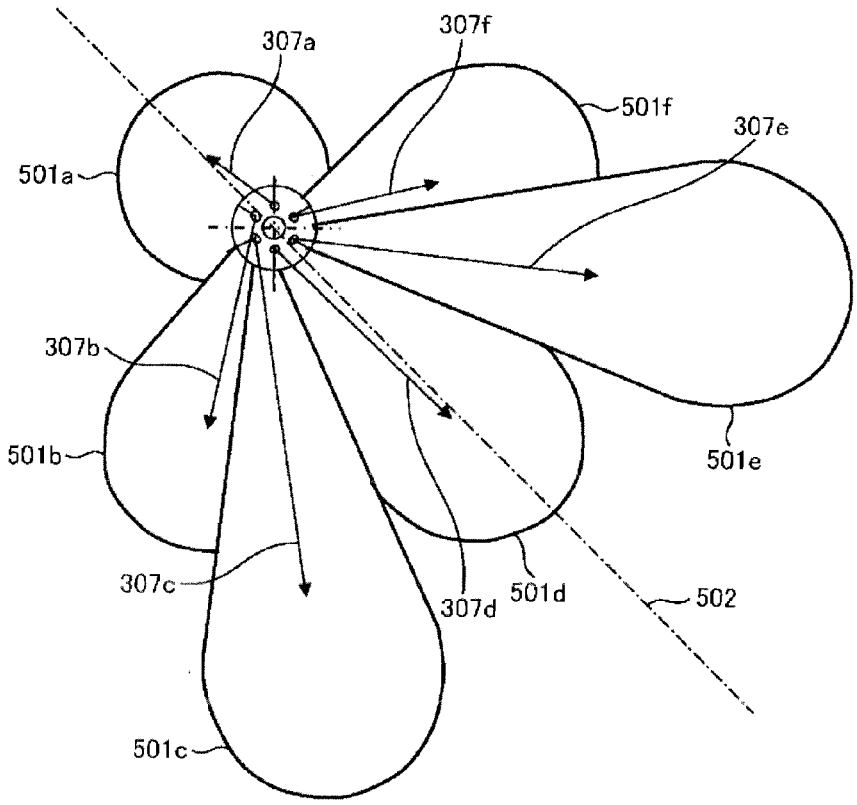
FIG. 5 is a view illustrating a fuel spray shape of the fuel injection valve according to the first embodiment of the present invention.
Figure 6:
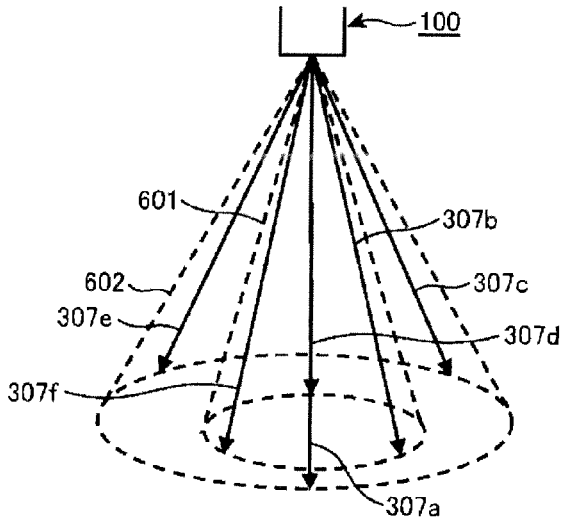
FIG. 6 is a view explaining the side surfaces of virtual cones formed by the direction of the fuel injection orifice axes in the fuel injection valve according to the first embodiment of the present invention.
Figure 7:
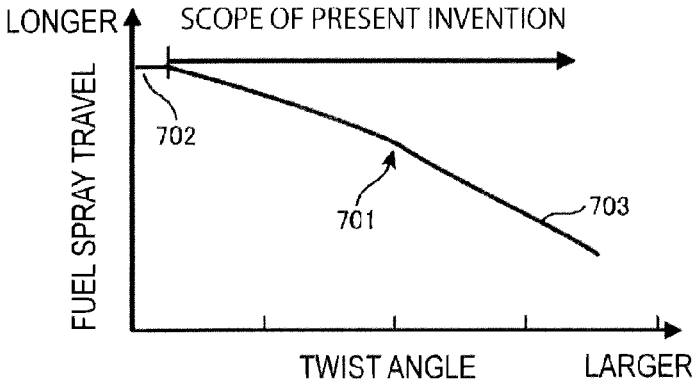
FIG. 7 is a graph for explaining an effect of a twist angle of the fuel injection orifice in the first embodiment of the present invention.

FIG. 1 is a vertical cross-section view parallel to a center axis of a fuel injection valve that illustrates an example of an electromagnetic fuel injection valve as an example of a fuel injection valve according to the present invention. FIG. 2 is an enlarged vertical cross-section view of a bottom end portion of a nozzle body in the fuel injection valve according to the first embodiment. FIG. 3 is a cross-section view along line A-A in FIG. 2, and is an enlarged view for explaining the constitution (positional relationship of the inlets and outlets and the like) of fuel injection orifices. FIG. 4 is an enlarged view of one of the fuel injection orifices of FIG. 3, and is an enlarged view for explaining the flow near the fuel injection orifice and the effects thereof. FIG. 5 is a view explaining the directions of fuel injection orifice axes (also called orifice axes) and a fuel spray shape formed when injecting fuel in the fuel injection valve according to the first embodiment. FIG. 6 is a view explaining the side surfaces of virtual cones formed by the directions of the fuel injection orifice axes in the fuel injection valve according to the first embodiment. FIG. 7 is a graph for explaining an effect of a twist angle of the fuel injection orifices in the first embodiment of the present invention.

An electromagnetic fuel injection valve 100 shown in FIG. 1 is an example of an electromagnetic fuel injection valve for a cylinder-direct-injection type gasoline engine. However, the effects of the present invention are also effective in an electromagnetic fuel injection valve for a port-injection type gasoline engine or a fuel injection valve that is driven by a piezo element or a magnetostrictive element.

<<Explanation of Injection Valve Basic Operation>>

In FIG. 1, fuel is supplied from a fuel supply port 112 into the fuel injection valve. The electromagnetic fuel injection valve 100 shown in FIG. 1 is a normally-closed, electromagnetic-actuation type fuel injection valve, and is configured such that when electric power is not fed to a coil 108, a valve body 101 is biased by a spring 110 to be pressed against a seat member 102 so that the fuel is sealed. At this time, in a fuel injection valve for cylinder injection, the pressure of fuel that is supplied is in the range of about 1 MPa to 35 MPa.

FIG. 2 is an enlarged cross-section view of the vicinity of fuel injection orifices 201 provided at the tip of the valve body 101. When the fuel injection valve is in a closed state, the valve body 101 abuts a valve seat surface 203 including a conical surface provided to a seat member 102 that is joined to a nozzle body 104 by welding or the like, and thereby the fuel seal is maintained. At this time, a contact part on the valve body 101 side is formed by a spherical surface 202, and contact between the valve seat surface 203 which is a conical surface and the spherical surface 202 occurs in an approximately linear contact state. When electric power is fed to the coil 108 shown in FIG. 1, a magnetic flux density is generated in a core 107, a yoke 109, and an anchor 106 which constitute a magnetic circuit of the electromagnetic valve, and a magnetic attractive force is generated between the core 107 and the anchor 106 where an air space exists. If the magnetic attractive force becomes larger than the biasing force of the spring 110 and the force of the above-mentioned fuel pressure, the valve body 101 is attracted to the core 107 side by the anchor 106 while being guided by a guide member 103 and a valve body guide 105, thereby entering an opened state.

When the valve body 101 enters an opened state, a gap is generated between the valve seat surface 203 and the spherical surface 202 of the valve body 101, and the injection of fuel is started. Once the injection of fuel is started, the energy that was imparted as fuel pressure is converted to kinetic energy so that fuel is injected up to the fuel injection orifices 201.

<<Explanation of Orifice Arrangement>>

Next, the fuel injection orifices 201 constituted in the seat member 102 and the effects of fuel that flows therethrough, as well as the fuel spray shape and the effects thereof will be explained in detail referring to FIGS. 3 to 7.

FIG. 3 is a cross-section view along line A-A of the seat member 102 shown in FIG. 2 excluding the valve body 101, for explaining in detail using the inlets and outlets of the fuel injection orifices 201 arranged on the valve seat surface 203 and the like.

A fuel injection orifice inlet 304*a* and a fuel injection orifice outlet 305*a* on the valve seat surface 203 are characterized by being constituted in the following relationship. A plane including a straight line 303*a* connecting a center point 302*a* of the fuel injection orifice inlet 304*a* with an apex 301 of the valve seat surface 203 as well as the center axis 204 in the vertical direction of the fuel injection valve intersects a plane that includes a straight line 307*a* connecting the center point 302*a* of the fuel injection orifice inlet 304*a* with a center point 306*a* of the fuel injection orifice outlet 305*a* and is parallel to the center axis 204 in the vertical direction of the fuel injection valve to form an angle that is greater than 0° (forming a twist angle 308*a*). The center axis 204 in the vertical direction of the fuel injection valve is the same as a center axis of the nozzle body 104. In the above explanation, 302*a* to 307*a* were explained as a representative example, but in the present embodiment, 302*b* to 307*b*, 302*c* to 307*c*, 302*d* to 307*d*, 302*e* to 307*e*, and 302*f* to 307*f* are also the same in that a plane including a straight line connecting a center point of the fuel injection orifice inlet with an apex of the valve seat surface as well as the center axis in the vertical direction of the fuel injection valve intersects a plane that includes a straight line connecting the center point of the fuel injection orifice inlet with a center point of the fuel injection orifice outlet and is parallel to the center axis in the vertical direction of the fuel injection valve to form an angle that is greater than 0°.

In the present embodiment, fuel is injected such that the fuel injection orifice including the fuel injection orifice inlet 304*b* and the fuel injection orifice outlet 305*b*, the fuel injection orifice including the fuel injection orifice inlet 304*d* and the fuel injection orifice outlet 305*d*, and the fuel injection orifice including the fuel injection orifice inlet 304*f* and the fuel injection orifice outlet 305*f* constitute a first fuel spray, and the fuel injection orifice including the fuel injection orifice inlet 304*a* and the fuel injection orifice outlet

305*a*, the fuel injection orifice including the fuel injection orifice inlet 304*c* and the fuel injection orifice outlet 305*c*, and the fuel injection orifice including the fuel injection orifice inlet 304*e* and the fuel injection orifice outlet 305*e* constitute a second fuel spray. The second fuel spray is injected so as to surround the first fuel spray on the outer periphery of the first fuel spray. In other words, the second fuel spray constitutes an outline fuel spray of the second fuel spray.

In the present embodiment, the first fuel spray and the second fuel spray are both constituted as a plurality of fuel sprays that are injected from a plurality of fuel injection orifices, and each fuel spray is independently dispersed in the circumferential direction. Therein, by imparting the fuel injection orifices that inject the fuel sprays that constitute the first fuel spray with a twist angle, the fuel spray travel (penetration) can be shortened and the adherence of fuel to the air intake valve or the wall surface within the cylinder can be suppressed.

In the present embodiment, all of the fuel injection orifices are imparted with a twist angle. Thus, while the twist angle was explained only for the fuel injection orifice including the fuel injection orifice inlet 304*a*, a twist angle is also imparted to the fuel injection orifices including the fuel injection orifice inlets 304*b*, 304*d*, and 304*f* for which the fuel spray travel is to be shortened, and the operational effects thereof are the same as those of the fuel injection orifice including the fuel injection orifice inlet 304*a*.

<<Explanation of the Flow and Effects>>

The operational effects achieved by constituting the fuel injection orifices as described above will now be explained referring to FIGS. 4 to 7. FIG. 4(*a*) is an enlarged view of one fuel injection orifice, and explains the fuel flow into the fuel injection orifice inlet 304*a* and the fuel flow toward the fuel injection orifice outlet 305*a* (not illustrated, but in the upward left direction). FIG. 4 (*b*) explains the flow in the case of a fuel injection orifice that does not have the constitution of the present embodiment for the sake of comparison with FIG. 4(*a*). FIG. 5 is a view explaining a fuel spray that is injected by the fuel injection valve according to the present embodiment. FIG. 6 is a view explaining the virtual cone surfaces formed by the fuel injection orifice axes according to the present embodiment. FIG. 7 is a graph for explaining the effect of the twist angle on the fuel spray travel.

In FIG. 4(*a*), in the case that the plane including the straight line 303*a* connecting the apex 301 (not illustrated, but in downward right direction) of the valve seat surface with the center point 302*a* of the fuel injection orifice inlet 304*a* as well as the center axis in the vertical direction of the fuel injection valve intersects the plane that includes the straight line 307*a* connecting the center point 302*a* of the fuel injection orifice inlet 304*a* with the center point 306*a* (not illustrated, but in the upward left direction) of the fuel injection orifice outlet 305*a* and is parallel to the center axis in the vertical direction of the fuel injection valve to form the twist angle 308*a*, as in the fuel injection orifice inlet 304*a*, the fuel flow is as follows. A fuel flow 410 flowing toward the fuel injection orifice inlet 304*a* creates a flow 411 that is twisted in the direction of the straight line 307*a* in the fuel injection orifice inlet 304*a*, and then the fuel flows toward the fuel injection orifice outlet 305*a* (not illustrated) as a flow 412 within the fuel injection orifice. In the fuel injection orifice inlet 304*a*, when the fuel is twisted, it is pressed inside the fuel injection orifice which changes its flow velocity distribution, such that a flow velocity distribution 410' that has no deviations becomes a flow velocity distribution 412' that has deviations. This flow that has deviations is injected from the fuel injection orifice outlet 305*a* to constitute a fuel spray 501*a* as illustrated in FIG. 5. When fuel is injected from the fuel injection orifice 201, the fuel whose flow velocity distribution has deviations due to the twisting described above has a velocity component toward a direction 413 whose flow velocity distribution has deviated due to the twisting compared to a case in which the flow is not twisted and the flow velocity distribution has no deviations (422' that will be explained below). Thus, the fuel can easily spread after being injected from the fuel injection orifice so that a large amount of air around the fuel injection orifice outlet 305*a* is caught up in the spray to increase the shear resistance between the air and the fuel, and thereby the fuel spray travel can be shortened.

For example, as in a fuel injection orifice 404 shown in FIG. 4(*b*), if a plane including a straight line 403 connecting the apex 301 (not illustrated, but in downward right direction) of the valve seat surface with a center point 402 of the fuel injection orifice inlet as well as the center axis 204 in the vertical direction of the fuel injection valve matches a plane that includes a straight line 407 connecting the center point 402 of the fuel injection orifice inlet with a center point (not illustrated, but in the upward left direction) of the fuel injection orifice outlet and is parallel to the center axis 204 in the vertical direction of the fuel injection valve (in other words, if the twist angle is 0°), a flow velocity distribution 420' of fuel 420 that flows in becomes a flow 422 that flows within the fuel injection orifice, but its flow velocity distribution 422' does not change. In this case, deviations are not generated in the fuel flow, and thus the fuel that is sprayed cannot easily spread and a large amount of air around the fuel injection orifice outlet is not caught up in the spray after injection. Therefore, the shear resistance between the air and the fuel is small, and the fuel spray travel becomes long.

FIG. 7 illustrates a relationship line 701 when the twist angle is represented on the horizontal axis and the fuel spray travel is represented on the vertical axis. The effects obtained in the present embodiment are rooted in a phenomenon generated by the fuel flow velocity because the flow velocity distribution deviates due to the twisting at the inlet of the fuel injection orifices. Therefore, even with a difference on the level of a deviation in the orifice opening position of the fuel injection orifice, a minute twist angle will be structurally constituted in the fuel injection orifice, but the effects cannot be obtained with the small disturbance that is generated by such a minute twist angle. Therefore, there is a region 702 in which the fuel spray travel does not change, and the fuel spray travel is shortened as in 703 after the twist angle exceeds a certain level. It is understood that this twist angle is preferably 5° or more.

The above explanation was directed to the fuel injection orifice inlet 304*a*, but the same operational effects are also achieved in the fuel injection orifice inlets 304*b* to 304*f*, and the fuel spray travel can also be shortened in the fuel sprays 501*b* to 501*f* from the fuel injection orifice outlets 305*b* to 305*f*.

In the present embodiment, the straight lines 307*a* to 307*f* connecting the center of the inlet with the center of the outlet in the fuel injection orifices are constituted as described below. The straight lines 307*a*, 307*c*, and 307*e* connecting the center of the inlet with the center of the outlet in the fuel injection orifices are arranged along a virtual cone surface 602 that is constituted with its apex on the center axis 204 of the fuel injection valve. The straight lines 307*b*, 307*d*, and 307*f* connecting the center of the inlet with the center of the outlet in the fuel injection orifices are arranged along a virtual cone surface 601 that is constituted with its apex on the center axis 204 of the fuel injection valve. Thus, the straight lines connecting the center of the inlet with the center of the outlet in the fuel injection orifices are arranged along one virtual cone surface among the two virtual cone surfaces mentioned above. Thereby, various fuel spray shapes can be constituted to produce excellent lay out when injecting fuel in an internal combustion engine. In the present embodiment, there are two virtual cone surfaces, but the straight lines connecting the center of the inlet with the center of the outlet in the fuel injection orifices (hereinafter also referred to as fuel spray orifice axes, or simply orifice axes) can also be arranged along one virtual cone surface among three or more virtual cone surfaces. Further, the apexes of the virtual cone surfaces 601 and 602 can be appropriately displaced from the center axis 204 of the fuel injection valve, and thereby the layout of the fuel spray can be further improved.

In the present embodiment, the twist angles 308*b* and 308*f* as well as 308*c* and 308*e* for the pair of fuel sprays 501*b* and 501*f* and the pair of fuel sprays 501*c* and 501*e* relative to a fuel spray axis of symmetry 502 in FIG. 5 are set to be equal. Thereby, each fuel spray travel is approximately the same, and thus the symmetry of the fuel spray shape is further improved.

In the present embodiment, considering a case in which fuel is injected in an internal combustion engine, the twist angles 308*a* to 308*f* are set to be proportional to the distances to the top and bottom surfaces and side surfaces in the cylinder within the internal combustion engine. Thereby, if the distance to a component in the internal combustion engine is short, the fuel spray travel of the relevant fuel injection orifice can be further shortened relative to the other orifices by increasing the twist angle of the relevant fuel injection orifice. This achieves a further advantage in that fuel can be injected without the fuel spray colliding into the components within the internal combustion engine.

In the present embodiment, a case in which the fuel injection orifices 201 have a cylindrical shape was explained. However, the same operational effects can be achieved and the effects of the present embodiment are not lost even if the fuel injection orifices are linear or curved toward the outlet and enlarged or reduced. In the present embodiment, the fuel injection orifice inlets 304*a* to 304*f* in the seat surface are constituted at approximately equal intervals at equal distances from the center axis 204 of the fuel injection valve. However, the operational effects of the present embodiment are not lost even if the distances of the fuel injection orifice inlets from the center axis 204 of the fuel injection valve are different or the intervals between the fuel injection orifices are different. In the present embodiment, the number of fuel injection orifices is 6. However, the same operational effects can be achieved and the effects are not lost even if the number of fuel injection orifices is different. Similarly, the operational effects achieved by the present invention are not lost even if a different fuel spray shape is constituted with the same number of fuel injection orifices.

Second Embodiment

Figure 8:
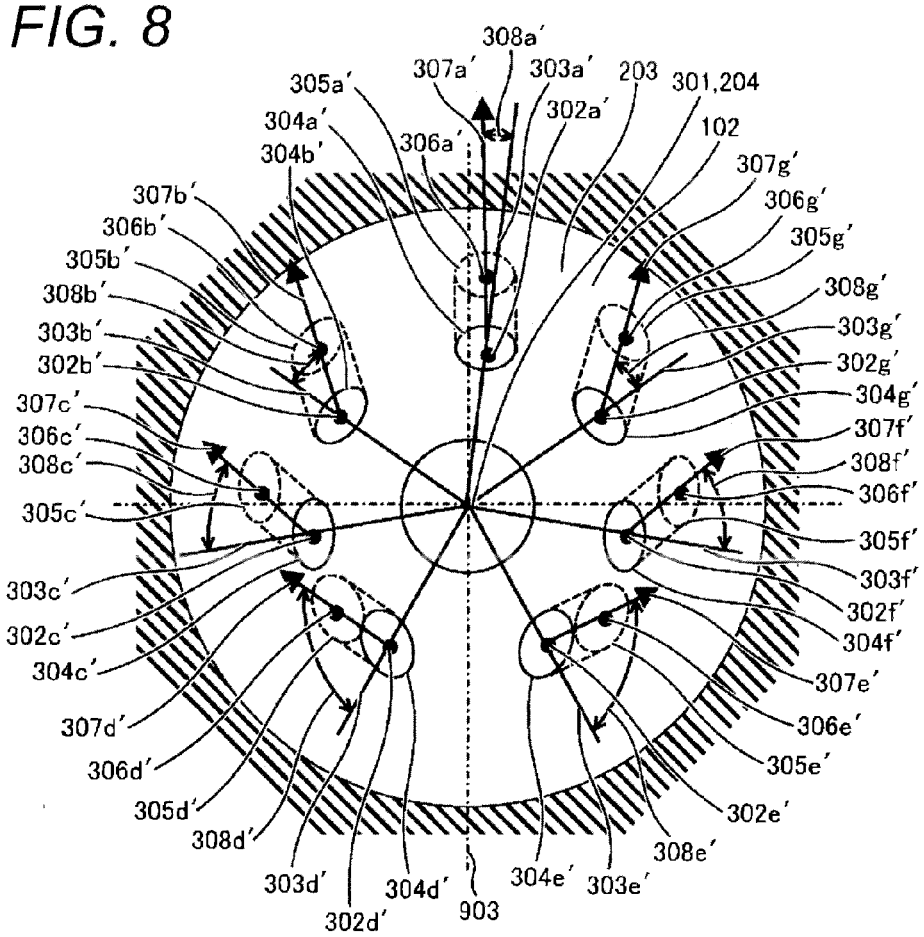
FIG. 8 is a view illustrating a constitution of fuel injection orifices of a fuel injection valve according to a second embodiment of the present invention.
Figure 9:
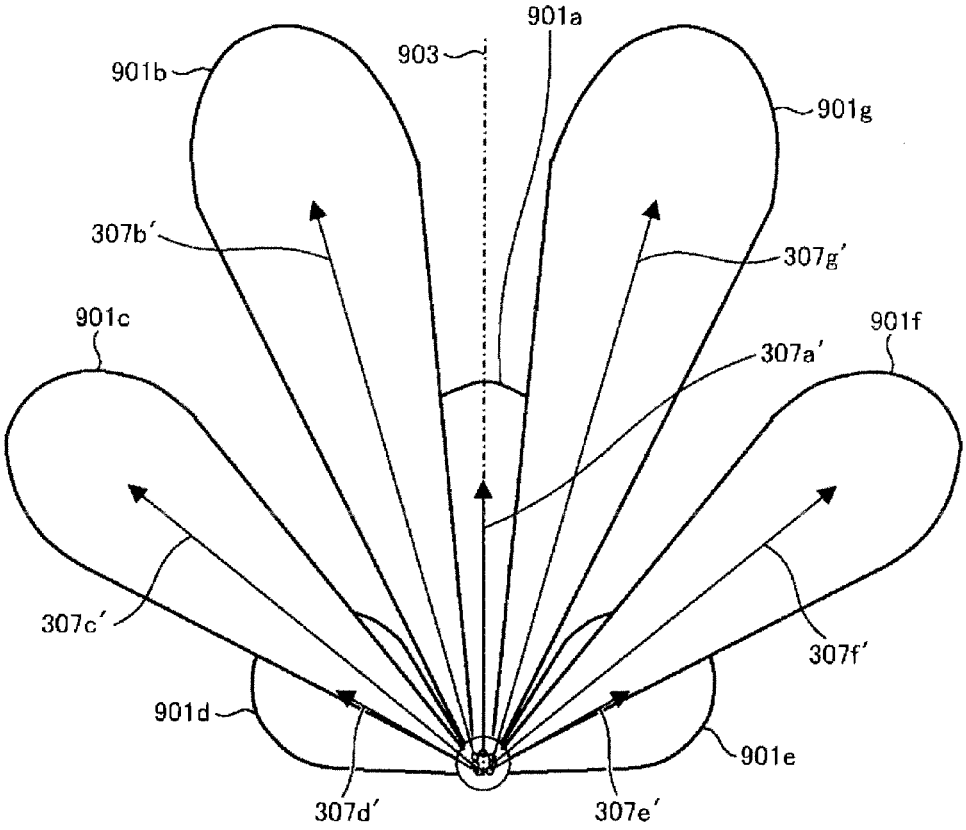
FIG. 9 is a view illustrating a fuel spray shape of the fuel injection valve according to the second embodiment of the present invention.

A fuel injection valve according to a second embodiment of the present invention will now be explained referring to FIGS. 8 and 9. FIG. 8 is a vertical cross-section view illustrating a constitution of fuel injection orifices of the fuel injection valve according to the present embodiment. In FIG. 8, members that are assigned the same number as in FIG. 3 have the same or equivalent function as in the first embodiment, and explanations thereof will be omitted. FIG. 9 is a view illustrating a fuel spray shape constituted in the present embodiment.

As a difference from the first embodiment, a fuel spray 901*a* corresponding to a straight line 307*a*' connecting the center of the inlet and the center of the outlet of one fuel injection orifice is injected at a center side, and fuel sprays 901*b* to 901*g* respectively corresponding to straight lines 307*b*' to 307*g*' connecting the center of the inlet and the center of the outlet of the other fuel injection orifices are injected so as to surround the outer edge. In other words, the fuel sprays 901*b* to 901*g* constitute an outline fuel spray of the fuel spray 901*a*.

With this constitution, the fuel spray 901*a* is surrounded by the fuel sprays 901*b* to 901*g*, and thus there are cases in which the fuel spray travel may be extended because the fuel spray does not easily receive air resistance. However, according to the present embodiment, a center 302*a*' of the fuel injection orifice inlet is separated from a plane including an axis of symmetry 903 of the fuel sprays and the center axis 204 of the fuel injection valve (extending at an orientation penetrating through the paper surface). Thereby, a plane including a straight line 303*a*' connecting a center point 302*a*' of the fuel injection orifice inlet with the apex 301 of the valve seat surface 203 as well as the center axis 204 in the vertical direction of the fuel injection valve forms a twist angle 308*a*' with a plane that includes a straight line 307*a*' connecting the center point 302*a*' of the fuel injection orifice inlet with a center point 306*a*' of the fuel injection orifice outlet and is parallel to the center axis 204 in the vertical direction of the fuel injection valve. Thus, the fuel spray travel can be shortened by the same mechanism as that in the first embodiment. Since the number of fuel injection orifices is greater than that in the first embodiment, the fuel injection orifice diameter can be decreased when injecting a flow amount of fuel equivalent to that in the first embodiment, and the atomization of the fuel spray can be enhanced.

In the present embodiment, the fuel spray 901*a* constitutes a first fuel spray, and the fuel sprays 901*b*, 901*c*, 901*d*, 901*e*, 901*f*, and 901*g* constitute a second fuel spray. In the present embodiment, the first fuel spray is constituted by a single fuel spray that is injected from one fuel injection orifice, and the second fuel spray is constituted by a plurality of fuel sprays that are injected from a plurality of fuel injection orifices, and each fuel spray is independently dispersed in the circumferential direction. Therein, by imparting the fuel injection orifice that injects the fuel spray 901*a* that constitutes the first fuel spray with a twist angle, the fuel spray travel (penetration) of the fuel spray 901*a* can be shortened and the adherence of fuel to the air intake valve or the wall surface within the cylinder can be suppressed.

In the present embodiment, a case in which the fuel injection orifices have a cylindrical shape was explained. However, the same operational effects can be achieved and the effects of the present embodiment are not lost even if the fuel injection orifices are linear or curved toward the outlet and enlarged or reduced. In the present embodiment, the fuel injection orifice inlets in the seat surface are constituted at approximately equal intervals at equal distances from the center axis of the fuel injection valve. However, the operational effects of the present embodiment are not lost even if the distances of the fuel injection orifice inlets from the center axis of the fuel injection valve are different or the intervals between the fuel injection orifices are different. In the present embodiment, the operational effects achieved by the present invention are not lost even if a different fuel spray shape than that of the present embodiment is constituted.

REFERENCE SIGNS LIST

101 valve body
102 seat member
103 guide member
104 nozzle body
105 valve body guide
106 anchor
107 magnetic core
108 coil
109 yoke
110 biasing spring
111 connector
112 fuel supply port
201 fuel injection orifice
202 spherical surface of valve body
203 valve seat surface
204 center axis in the vertical direction of the fuel injection valve
301 apex of valve seat surface
302*a* to 302*f* center point of fuel injection orifice inlet
303*a* to 303*f* straight line connecting the center axis of the fuel injection valve with the center of the fuel injection orifice inlet
304*a* to 304*f* fuel injection orifice inlet
305*a* to 305*f* fuel injection orifice outlet
306*a* to 306*f* center point of fuel injection orifice outlet
307*a* to 307*f* straight line connecting the center of the inlet with the center of the outlet of the fuel injection orifice
308*a* to 308*f* twist angle
410,420 fuel flow before flowing into the fuel injection orifice
411, 421 fuel flow at inlet of the fuel injection orifice
412, 422 fuel flow within the fuel injection orifice
501*a* to 501*f*, 901*a* to 901*g* fuel spray
502 axis of symmetry of fuel sprays
601,602 virtual cone surface
701 relationship line between twist angle and fuel spray travel

The invention claimed is:

1. A fuel injection valve comprising:
a valve seat surface that abuts a valve body to seat fuel; and
a plurality of fuel injection orifices having an inlet opening formed on the valve seat surface,
wherein the plurality of fuel injection orifices include a first injection orifice and a plurality of second injection orifices,
orifice axes connecting a center of an inlet with a center of an outlet in the second injection orifices are symmetrically arranged with respect to a plane of symmetry including a center axis of the fuel injection valve,
a center of the inlet opening of the first injection orifice is separated without contacting the plane of symmetry, and
a plane that includes an orifice axis connecting a center of an inlet with a center of an outlet in one of the second injection orifices and is parallel to the center axis of the fuel injection valve intersects a plane including a straight line passing through the center of the inlet of the one second injection orifice and a conical apex that forms the valve seat surface as well as the center axis of the fuel injection valve to form an inclination angle that is larger than 0°.

2. The fuel injection valve according to claim 1, wherein
a segment connecting a center of an inlet with a center of an outlet in the first injection orifice is separated without connecting the plane of symmetry.

3. The fuel injection valve according to claim 1, wherein
a plane that includes an orifice axis connecting a center of an inlet with a center of an outlet in the first injection orifice and is parallel to the center axis of the fuel injection valve is parallel to the plane of symmetry.

4. The fuel injection valve according to claim 1, wherein
a plurality of fuel sprays injected from the second injection orifices are injected at an outer periphery of a fuel spray injected from the first injection orifice.

5. The fuel injection valve according to claim 1, wherein
a plurality of fuel sprays injected from the second injection orifices are injected along one virtual cone surface.

6. The fuel injection valve according to claim 5, wherein
a plurality of fuel sprays injected from the second injection orifices are injected such that each spray injected from the second injection orifices is dispersed in a circumferential direction.

* * * * *